US005881912A

United States Patent [19]

Bokros

[11] Patent Number: 5,881,912

[45] Date of Patent: Mar. 16, 1999

[54] GLUE GUN WITH REMOVABLE BARREL

[75] Inventor: Les Bokros, Ft. Worth, Tex.

[73] Assignee: Uniplast, Inc., Arlington, Tex.

[21] Appl. No.: 785,349

[22] Filed: Jan. 17, 1997

[51] Int. Cl.[6] ..... B67D 5/62

[52] U.S. Cl. ..... 222/1; 222/146.5; 222/146.2; 219/227

[58] Field of Search ..... 222/146.5, 146.2; 401/1, 2; 219/227, 230, 240, 421

[56] References Cited

U.S. PATENT DOCUMENTS

| | | | |
|---|---|---|---|
| D. 315,283 | 3/1991 | De Carolis et al. | D8/71 |
| 1,237,862 | 8/1917 | Bintliff . | |
| 1,409,616 | 3/1922 | Taddeo . | |
| 1,449,517 | 3/1923 | Lame . | |
| 1,769,437 | 7/1930 | Kromer . | |
| 2,117,179 | 5/1938 | Kopp . | |
| 2,255,578 | 9/1941 | Baker . | |
| 2,556,609 | 6/1951 | Arkless . | |
| 2,773,496 | 12/1956 | Czarnecki . | |
| 2,871,333 | 1/1959 | Savage . | |
| 3,032,635 | 5/1962 | Kraft . | |
| 3,109,045 | 10/1963 | Silverman . | |
| 3,154,811 | 11/1964 | Gardener . | |
| 3,199,740 | 8/1965 | Juffa et al. . | |
| 3,204,828 | 9/1965 | Paulsen . | |
| 3,228,566 | 1/1966 | Knox, Jr. | 222/146 |
| 3,314,573 | 4/1967 | Newton . | |
| 3,430,816 | 3/1969 | Nadherny et al. . | |
| 3,443,059 | 5/1969 | Spencer . | |
| 3,459,335 | 8/1969 | Cohen et al. . | |
| 3,466,752 | 9/1969 | Braun . | |
| 3,485,417 | 12/1969 | Cocks . | |
| 3,519,792 | 7/1970 | Solomon | 219/222 |

(List continued on next page.)

FOREIGN PATENT DOCUMENTS

| | | | |
|---|---|---|---|
| 729851 | 1/1932 | France . | |
| 914405 | 9/1945 | France . | |
| 2 249 924 | 6/1982 | France | B05C 17/005 |
| 2 511 511 | 9/1976 | Germany | B05C 9/14 |
| 3 125 597 | 6/1983 | Germany | B05C 17/00 |
| 41 11 248 A1 | 10/1992 | Germany . | |
| 0 0909 921 A | 7/1982 | United Kingdom . | |

OTHER PUBLICATIONS

*Derwent Abstract,* German Patent DE 2 511 511, Sep. 30, 1976.

*Derwent Abstract, French Patent* FR 2 495 024, Jun. 4, 1982.

*Derwent Abstract,* German Patent DE 3 125 597, Jun. 1, 1983.

*Primary Examiner*—Steven O. Douglas

*Attorney, Agent, or Firm*—Mark W. Handley; Gregory M. Howison

[57] ABSTRACT

A hot glue dispenser (10) is disclosed having a dispenser section (12) and a removable heater section (14). The dispenser section (12) includes a feeder handle (16) having a main body portion (30) which extends to a provide a hand grip (35). A feeder mechanism (18) is mounted to the feeder handle (16). The feeder mechanism (18) is operable to feed glue sticks (15) from the dispenser section (12) into the heater section (14). The heater section (14) is removably secured to the feeder handle (16) of the dispenser section (12) by a releasable latch (24). The heater section (14) includes a heating cartridge (22) and a protective housing (26). The protective housing (26) includes an interior cavity (160) within which the heating cartridge (22) is mounted, with a gap (170) extending substantially fully between the heating cartridge (22) and the protective housing (26) to provide a thermal barrier. A feed passage (150) extends interiorly through the heating cartridge (22) for passing a glue stick (15) from the feeder handle (16) to a dispensing end of the heating cartridge (22). A nozzle (145) is provided on the discharge end of the heating cartridge (22) to provide a dispensing tip (147) for dispensing a melted end of the glue stick (15). A thermally protective shroud (172) is mounted to the exterior of the nozzle (145).

28 Claims, 7 Drawing Sheets

U.S. PATENT DOCUMENTS

| | | | |
|---|---|---|---|
| 3,522,413 | 8/1970 | Chrow . | |
| 3,560,703 | 2/1971 | Chedister . | |
| 3,744,921 | 7/1973 | Weller et al. . | |
| 3,896,973 | 7/1975 | Morgan . | |
| 4,065,034 | 12/1977 | Callan . | |
| 4,067,481 | 1/1978 | Feldman . | |
| 4,103,145 | 7/1978 | Oliveri . | |
| 4,320,857 | 3/1982 | Herb et al. . | |
| 4,334,142 | 6/1982 | Blackmore . | |
| 4,463,877 | 8/1984 | Siwon . | |
| 4,601,597 | 7/1986 | Bertram et al. . | |
| 4,639,155 | 1/1987 | Schuster et al. . | |
| 4,692,587 | 9/1987 | Spirk, Jr. et al. | 219/242 |
| 4,776,490 | 10/1988 | Wingert . | |
| 4,781,482 | 11/1988 | Ursprung . | |
| 4,826,049 | 5/1989 | Speer | 222/146.5 |
| 4,926,029 | 5/1990 | Pearson . | |
| 4,933,192 | 6/1990 | Darling et al. . | |
| 4,938,388 | 7/1990 | Yeh . | |
| 4,951,846 | 8/1990 | Oster et al. | 222/146.5 |
| 4,998,698 | 3/1991 | Martinson | 248/176 |
| 5,026,187 | 6/1991 | Belanger et al. . | |
| 5,047,742 | 9/1991 | Fortune | 228/20 |
| 5,048,722 | 9/1991 | Lichu | 222/146.2 |
| 5,236,269 | 8/1993 | Handy . | |
| 5,240,141 | 8/1993 | Blette . | |
| 5,324,305 | 6/1994 | Kanner . | |
| 5,362,164 | 11/1994 | Wingert . | |
| 5,375,766 | 12/1994 | Sweeney . | |
| 5,462,206 | 10/1995 | Kwasie | 222/146.5 |
| 5,664,701 | 9/1997 | Massena | 222/146.5 |
| 5,769,272 | 6/1998 | Massena | 222/1 |
| 5,779,103 | 7/1998 | Massena | 222/146.5 |

FIG. 6
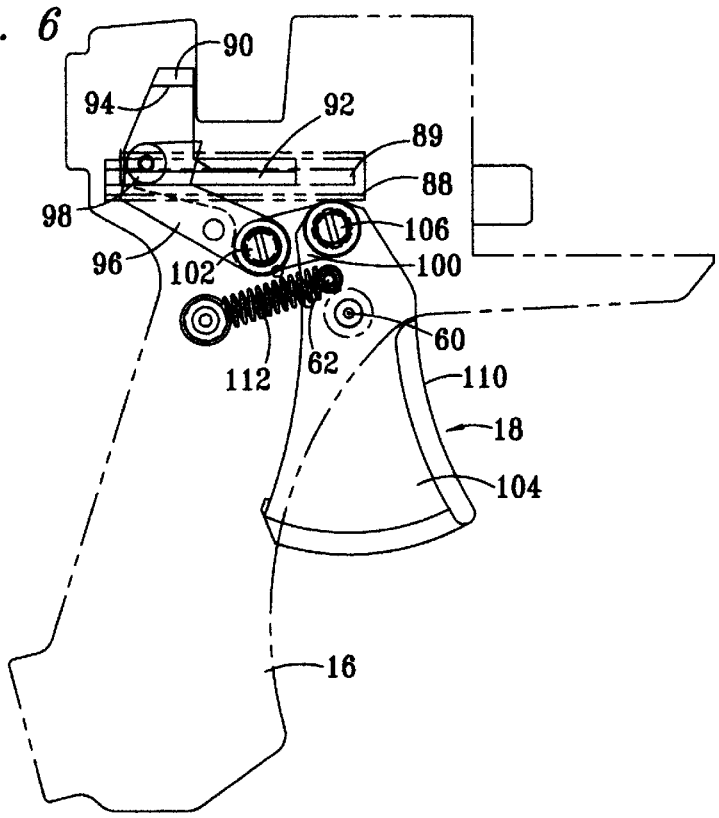
FIG. 7
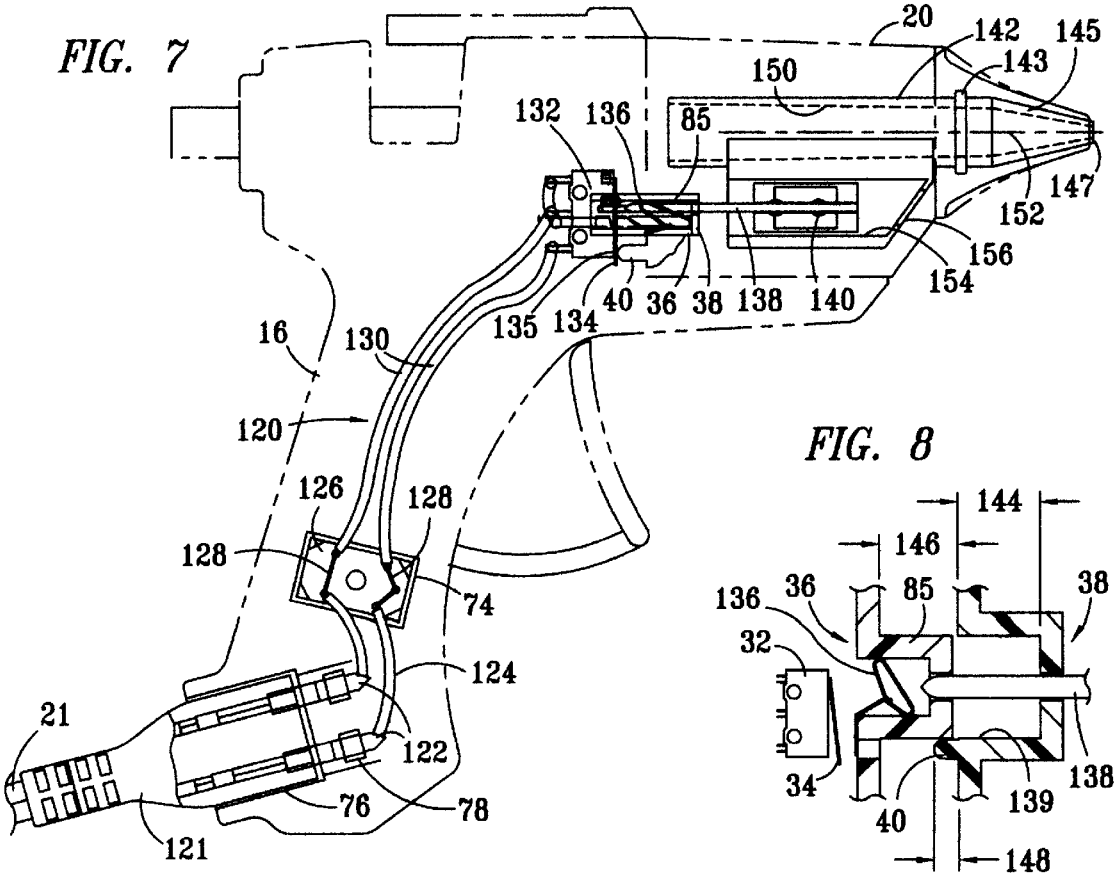
FIG. 8

GLUE GUN WITH REMOVABLE BARREL

CROSS REFERENCE TO RELATED APPLICATIONS

The following application is related to U.S. application Ser. No. 08/785,347, entitled "Removable Cartridge for a Hot Glue Gun," and U.S. application Ser. No. 08/785,348, entitled "Feeder Handle for a Hot Glue Gun, " both applications being filed of even date with the present application, on Jan. 17, 1997.

TECHNICAL FIELD OF THE INVENTION

The present invention relates in general to hot glue dispensers, and in particular to a hot glue dispenser having a removable heating cartridge.

BACKGROUND OF THE INVENTION

Hot glue dispensers have been utilized for dispensing hot glues for use as an adhesive. The hot glue dispensers, which are often called glue guns, have been made as a single units which have a heater section which is permanently mounted to a dispenser section. The dispenser sections of the hot glue dispensers have included a glue feeder assembly and a pistol grip handle. If a person using such a glue dispenser wished to dispense two different types of glue from a single dispenser, such as glues having different colors, thicknesses or other properties, the first type of glue stick had to be removed from within the hot glue dispenser and any remaining glue discharged from within the glue dispenser prior to inserting and dispensing the second type of glue.

Hot glue dispensers typically include resistive heating elements which are heated to elevated temperatures for melting glue sticks. These elevated temperatures pose hazards to persons if the heating elements are not enclosed within a thermally protective housing. Additionally, electrical current is necessary for the heating elements to operate. Persons utilizing hot glue dispensers may also suffer injury if they touch hot electrical contacts for providing electrical power to the resistive heating elements.

SUMMARY OF THE INVENTION

The present invention disclosed and claimed herein comprises a hot glue dispenser having a feeder handle and a removable cartridge barrel, which are secured together by a releasable latch. The feeder handle has a main body portion which provides a hand grip. A feeder mechanism is included within the feeder handle, and is operable to feed glue sticks from the feeder handle into the removable cartridge barrel. A heating cartridge is disposed within the removable cartridge barrel. The heating cartridge includes an electric resistance heater. The removable cartridge barrel provides a thermally protective housing, which includes an interior cavity within which the heating cartridge is mounted, with a gap extending substantially fully between the heating cartridge and the protective housing to provide a thermal barrier. A feed passage extends interiorly through the heating cartridge for passing a glue stick from the feeder handle to a dispensing end of the heating cartridge. A nozzle is provided on the discharge end of the heating cartridge to provide a dispensing tip for dispensing a melted end of the glue stick.

In another aspect of the present invention, a gripper aperture of the feeder mechanism has a selectably adjustable diameter for gripping of glue sticks of various sizes.

In still another aspect of the present invention, the nozzle is releasably mounted to the heating cartridge and a thermally protective shroud extends around exterior surfaces of the nozzle.

In yet another aspect of the present invention, the hot glue dispenser includes an electrical power switch which automatically disconnects electrical power from an electrical connector on the feeder handle when the removable cartridge barrel is removed from the feeder handle.

In still yet another aspect of the present invention, the protective housing of the heater section includes a plurality of laterally extending exterior fins which provide exterior gripping surfaces for the heater section which an operator may grip with bare hands when the interior thereof is heated to operating temperatures.

In further another aspect of the present invention, the air gap which extends between the heating cartridge and the removable cartridge barrel is vented to the exterior of the removable cartridge barrel by air ports for transferring thermal energy by convection from within the removable cartridge barrel to the exterior thereof.

BRIEF DESCRIPTION OF THE DRAWINGS

For a more complete understanding of the present invention and the advantages thereof, reference is now made to the following description taken in conjunction with the accompanying Drawings in which:

FIG. 6 illustrates a side elevational view of a feeder mechanism of the feeder handle, with the exterior profile of the feeder handle depicted in phantom;.

FIG. 7 illustrates a side elevational view of the electrical components of the glue gun, with the exterior profile of the glue gun depicted in phantom;

FIG. 8 illustrates a partial, longitudinal section view of an electrical connector of the feeder handle and an electrical connector of the cartridge barrel of the glue gun;

DETAILED DESCRIPTION OF THE INVENTION

Figure 1:
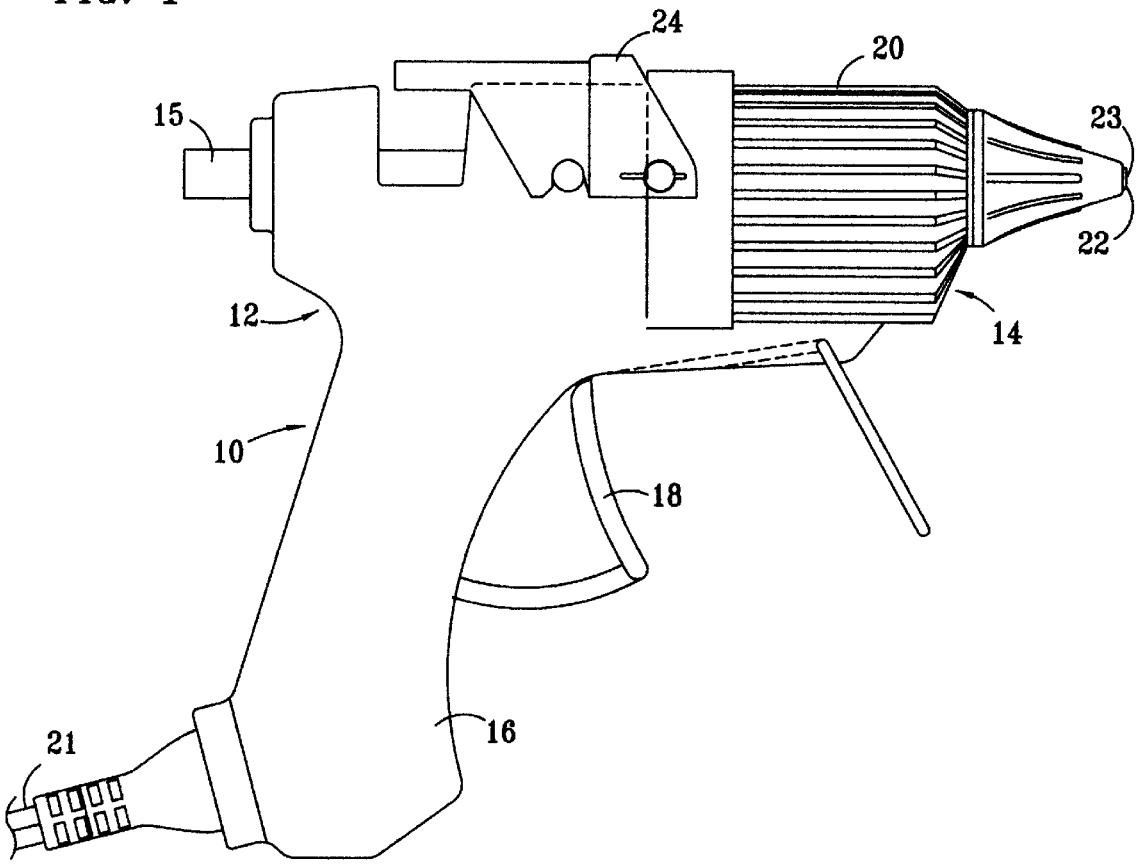
FIG. 1 illustrates is a side elevational view of a glue gun made according to a preferred embodiment of the present invention.

Referring now to FIG. 1, there is illustrated a side elevational view of a hot glue dispenser made according to the present invention, glue gun 10. The glue gun 10 includes a feeder section 12 and a heater section 14 for heating and then dispensing a melted end of a glue stick 15. The heater section 14 is detachable from the feeder section 12. The feeder section 12 includes a feeder handle 16. A feeder mechanism 18 of the feeder handle 16 may then be actuated to advance the glue stick 15 into the heater section 14. The electrical power cord 21 connects to an electrical power source, such as a household wall outlet, to provide operating power for heating the glue stick 15 within the heater section 14. The heater section 14 includes a removable cartridge barrel 20 which is releasibly secured to the feeder handle 16. The heater section 14 further includes a heating cartridge 22, which is disposed within the removable cartridge barrel 20. The cartridge barrel 20 provides a thermally protective shroud which extends around the heating cartridge 22, such that a person may handle the exterior of the cartridge barrel 20 when the heating cartridge 22 disposed therein is heated to operating temperatures. The glue stick 15 is heated in the heating cartridge 22 until it melts and then is dispensed from the nozzle tip 23 of the heating cartridge 22. A latch 24 secures the removable cartridge barrel 20 to the feeder handle 16.

Figure 2:
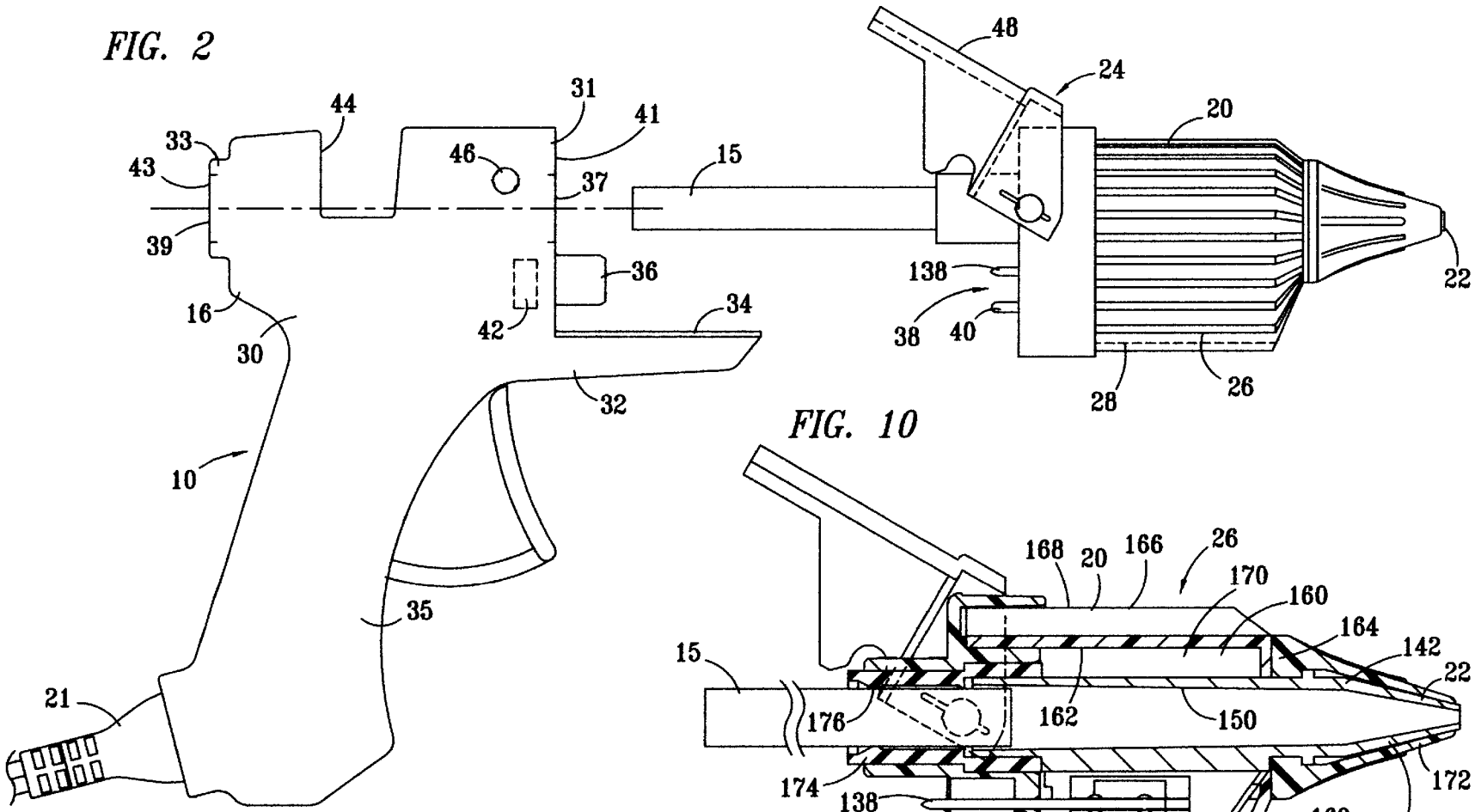
FIG. 2 illustrates a side elevational view of the glue gun, after removal of a cartridge barrel from a feeder handle thereof.

Referring now to FIG. 2, there is illustrated a side elevational view of the glue gun 10, after the removable cartridge barrel 20 has been removed from the feeder handle 16. The removable cartridge barrel 20 includes a thermally protective housing 26, within which the heating cartridge 22 is mounted. A groove is formed into the lower end of the protective housing 26 to provide a mounting channel 28. The feeder handle 16 includes a main body portion 30, from the forward end of which a cantilevered, forward end portion 32 extends. The forward end portion 32 of the feeder handle 16 includes an upwardly protruding portion 34 which provides a guide or track for engaging with the channel 28 in the lower end of the housing 26 of the removable cartridge barrel 20 to interlock the removable cartridge barrel 20 to the feeder handle 16 in a slidably movable, interlocked engagement. The upwardly protruding portion 34 of the feeder handle 16 will slidably engage the mounting channel 28 of the cartridge barrel 20 to guide the cartridge barrel 20 into engagement with the feeder handle 16, in correct alignment for latching therewith. This provides a self aligning feature for mounting the cartridge barrel 20 to the feeder handle 16.

The main body portion 30 includes a forward end 31 and a rearward end 33. The main body portion 30 extends downward from between the forward end 31 and the rearward end 33 to provide a pistol grip type of grip handle 35. A forward aperture 37 and a rearward aperture 39 extend through a forward face 41 and a rearward face 43, respectively, of the main body portion 30 of the feeder handle 16. The main body portion 30 further includes a first electrical connector 36 which mates with a second electrical connector 38 of the removable cartridge 20. The connector 36 extends with a tab-shaped housing for engaging within a socket of the connector 38. The protective housing 26 includes a protuberance 40, which is an actuator member that is provided by a rearwardly extending post or knob. The protuberance 40 is provided for engaging a switch 42, which is included within the feeder handle 16 for actuating the switch 42 to selectively connect and disconnect electrical power from the power cord 21 to the electrical connector 36. An access notch 44 extends into the top of the main body portion 30 of the feeder handle 16, such that the glue stick 15 may be viewed and accessed when the removable cartridge 20 is engaged with the feeder handle 16. The exterior of the main body portion 30 further includes latch catches 46 (one shown), which are provided by laterally extending tabs. The latch catches 46 are releasably engaged by a clasp 48 of the latch 24 to secure the removable cartridge barrel 20 to the feeder handle 16. The latch clasp 48 is pivotally mounted to the protective housing 26.

Figure 3:
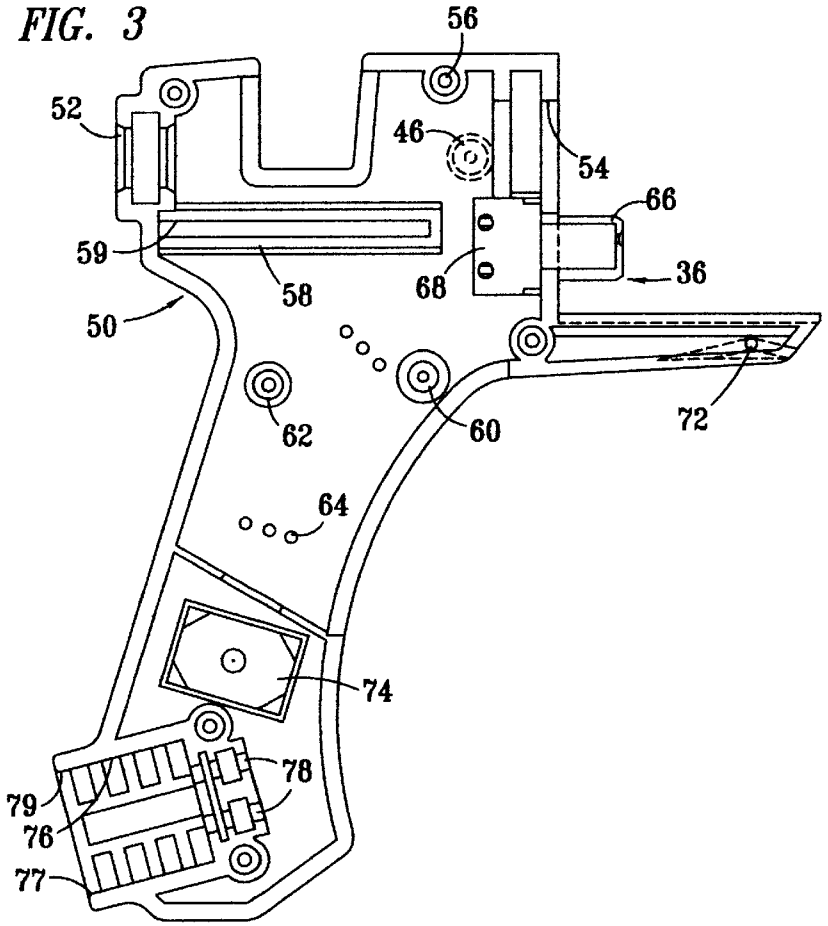
FIG. 3 illustrates side elevational view of the interior of a molded handle piece of the feeder handle.

Referring now to FIG. 3, there is illustrated side elevational view of the interior of a molded handle piece 50 of the feeder handle 16, which is preferably molded of a plastic, named VALOX 865, available from General Electric Company, of Pittsfield, Mass. The molded handle piece 50 includes a guide collar 52 and a forward opening 54 through which the glue stick 15 may be inserted. A plurality of cylindrical fastening recesses 56 are provided for securing the molded handle piece 50 to a mating molded handle piece 82 (shown in FIG. 4). The fastening recesses 56 each have a cylindrical body, with one end molded into the inside surface of handle piece 50 and extending laterally therefrom, and the other end thereof having a recess for receipt of a mounting tab and a screw fastener (not shown). A track 58 is molded into the handle piece 50, with the track 58 having a linearly extending slot 59, which faces a mating slot 89 of an oppositely disposed track 88 (shown in FIG. 4),which is molded into the second handle piece 82 (shown in FIG. 4) and extends parallel to the slot 59. A cylindrical shaft 60 is molded into the handle piece 50 and extends laterally to the side thereof. A trigger spring attachment point 62 and conductor retaining posts 64 also extend laterally aside of the molded handle piece 50. A cover housing half 66 of the connector 36 extends from the forward end of the molded handle piece 50. A flat 68 is formed into the side of molded handle piece 50 to provide a mounting surface for securing electrical components thereto. A recess extends into the forward end 32 of the molded handle piece 50, with a path 72 into which a glue gun stand (not shown) may be optionally installed. A flat mounting surface 74 is molded into the side of the molded handle piece 50 for securing electrical components thereto.

One half of a socket 76 is molded into the handle piece 50 for receiving an electrical connector of the power cord 21 (shown in FIG. 1). The lower end 77 of the interior periphery of the socket 76 is shaped with a flat bottom having squared comers and the upper end 79 of the interior periphery is shaped to have rounded corners for mating with a periphery of male plug on the end of the cord 21 such that the polarity of the legs of the conductors of the glue gun 10 correspond to different sized electrical prong blades which are included in the opposite end of the power cord 21. This configuration allows determination of the polarity of the different legs of the electrical power circuit within glue gun 10, that is, which leg is connected to the hot leg of a power source and which leg is connected to the neutral leg of a power source. Two apertures 78 extend from the forward end of the socket 76 with profiles for securing two electrical prong contacts therein.

Figure 4:
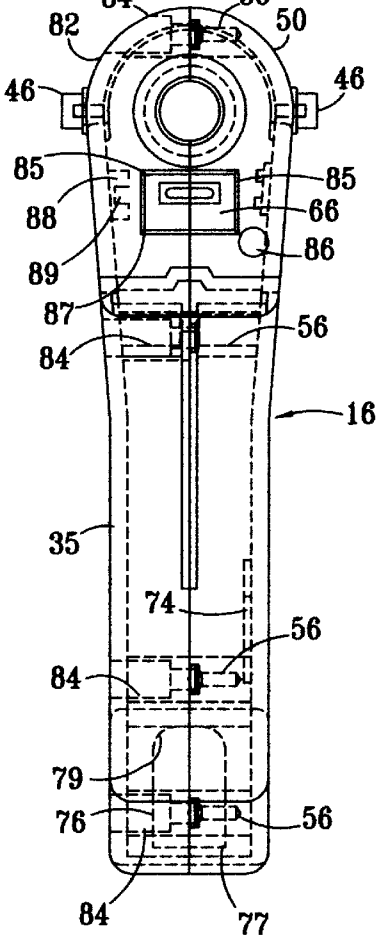
FIG. 4 illustrates a front elevational view of the feeder handle.

Referring now to FIG. 4, there is illustrated a front elevational view of the feeder handle 16. The feeder handle 16 includes the molded handle piece 50 and the mating molded handle piece 82. The exterior profiles of the molded handle pieces 50 and 82 are shaped such that when they are mated together, they together provide a hand grip 35, which in the preferred embodiment is a pistol type hand grip. The molded handle piece 82 is preferably formed of a plastic, VALOX 865, available from General Electric Company, of Pittsfield, Mass. The molded handle pieces 50 and 82 are secured together by joining fastening tabs 84 to fastening recesses 56 with screw fasteners (not shown). The fastening tabs 84 are molded into the interior profile of the mating molded handle piece 82, and extend laterally aside for engaging within the fastening recesses 56 of the molded handle piece 50. The fastening tabs 84 each have a cylindrical body, the interior of which includes a hole for receipt of the screws (not shown). An aperture 86 extends rearwardly into the molded handle piece 50 for receipt of the protuberance 40 when the removable cartridge barrel 20 is releasably secured to the feeder handle 16. The handle piece 82 further includes a molded cover half 87, which mates with the cover half 66 to provide a cover housing 85 of connector 36. The track 88 is molded into the handle piece 82 with the slot 89, which extends parallel to the opposite facing slot 59 of the track 58.

Figure 5:
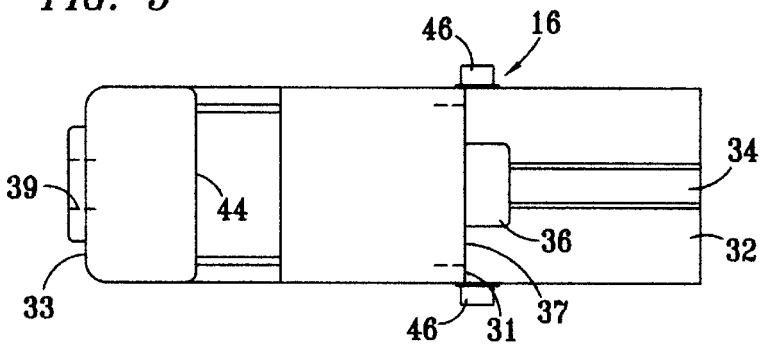
FIG. 5 illustrates a top view of the feeder handle.

Referring now to FIG. 5, there is illustrated a top view of the feeder handle 16. Latch catches 46 extend laterally from opposite sides of the feeder handle 16 for being engaged by the clasp 48 of the latch 24. The latch posts 46 are molded into the first and second molded handle pieces 50 and 82.

Referring now to FIG. 6, there is illustrated a side elevational view of the feeder mechanism 18, with the remainder of the feeder handle 16 depicted in phantom. The feeder mechanism 18 includes a gripper carriage 90 having linearly extending lugs 92, with longitudinal lengths which extend forward and rearward for engaging within the slots 59 and 89 (one shown) of respective ones of the tracks 58 and 88 (one shown) for slidably securing the carriage 90 to the molded handle pieces 50 and 82. The carriage 90 moves forward and rearwardly with respect to the feeder handle 16, along a linear path defined by the slots 59 and 89 formed within the tracks 58 and 88. A gripper aperture 94 extends through the rearward portion of the carriage 90, for grippingly engaging the exterior of a glue stick when the carriage 90 is moved forward with the glue stick 15 disposed therein. The gripper aperture 94 extends concentrically around the exterior of the glue stick 15, and preferably has a central axis which extends parallel with the longitudinal axis of the glue stick 15. The carriage 90 is secured to a linkage 96 by a linearly floating pivot point 98. The linkage 96 is secured to a linkage 100 by a free-floating pivot point 102. A trigger piece 104 is pivotly secured to the linkage 100 by a free-floating pivot point 106. The trigger piece 104 is also pivotly secured to the molded handle pieces 50 and 82 by the pivot shaft 60. The trigger piece 104 has a flat end surface 110 which is formed therein to provide an increased surface area for decreasing the pressure on a user's fingers when pushing the flat end surface 1 10 of the trigger piece 104 rearward into the main body portion 30 of the feeder handle 16. A spring 112 is secured from the trigger piece 104 to the trigger spring attachment point 62 for returning the trigger piece 104 to an initial position depicted in FIG. 6, after being pivoted around the pivot shaft 60 in response to pressure acting rearward on the flat end surface 110 thereof. In the preferred embodiment, the forward end of the linkage 96 moves upward to push the glue stick 15 into the top of the gripper aperture 94 when the trigger 104 is moved rearward and between the two molded pieces of the feeder handle 16, causing the glue stick 15 to be gripped within the aperture 94.

Referring now to FIG. 7, there is illustrated a side elevational view of the electrical components 120 of the glue gun 10, with the remainder of the feeder handle 16 depicted in phantom. The power cord 21 has a connector 121 which inserts into and mates with the socket 76, which is molded into the handle pieces 50 and 82. The profile of the exterior periphery of the connector 121 is curved on top and flat on bottom, with rounded corners at the top and squared corners at the bottom, for mating with the socket 76 and determining the polarity of the electrical conductors within the glue gun 10. Two conductive prongs 122 are mounted in the apertures 78 (shown in FIG. 2) for electrically connecting to the connector 121 of the power cord 21 when the connector 121 is engaged within the socket 76. Two conductors 124 are each connected on one end to separate ones of the conductive prongs 122, and on the other ends thereof are connected to two separate terminals of a fuse section provided by a circuit board 126. The circuit board 126 is mounted to the mounting section 74, which is molded into the handle piece 50. The circuit board 126 is preferably secured to the handle piece 50 by mounting screws (not shown). The circuit board 126 has two fusible links 128 for fusing both legs of the of the conductors 124 and the power cord 21.

Two conductors 130 are each connected on one end to separate terminals of the circuit board 126, with one connected to the hot leg of the power source and the other connected to the neutral leg of the power source. The other end of one of the conductors 130 which is connected to the hot leg of the power source is connected to the microswitch 132. The other end of the one of the conductors 130 which is connected to the neutral leg of the power source is connected directly to one of the contacts 136 of the electrical connector 36. The microswitch 132 is mounted to the mounting surface 68 (shown in FIG. 10), which is molded into the handle piece 50. The microswitch 132 is secured to the handle piece 50 by mounting screws (not shown). The microswitch 132 has a switch plate 134, which when pushed inward toward the main body of the microswitch 132 by the surface 135 of the rearward most end tip of the protuberance 40, electrically connects the one of the conductors 130 connected to the hot leg of the power supply to the electrical connectors 36.

The electrical connector 36 of the feeder handle 16 includes a cover housing 85, in which two spring contacts 136 are mounted to provide electrical contacts. The microswitch 132, when the switch plate 134 is pushed inward by the protuberance 40, connects the one of the conductors 130 connected to the hot leg of the power supply to a respective one of the contacts 136. When the switch plate 134 is not pushed inward by the protuberance 40, the one of the conductors 130 connected to the hot leg of the power supply is disconnected from a respective one of the contacts 136. The electrical connector 38 of the cartridge barrel 20 includes two prong contacts 138, which extend from a resistive heating element 140 that is disposed within the cartridge barrel 20. When the cartridge barrel 20 is mounted to the feeder handle 16, the electrical connector 36 of the feeder handle 16 mates with the electrical connector 38 of the cartridge barrel 20. The mounting channel 28 of the cartridge barrel 20 will slidably engage the upwardly protruding portion 34 of the feeder handle 16 to automatically and correctly align the electrical connector 38 with the electrical connector 36 as cartridge barrel 20 mounted to the feeder handle 16 by sliding rearward on the forward end 32 of the feeder handle 16.

Referring now to FIG. 8, there is illustrated a partial, longitudinal section view of the first electrical connector 36 of the feeder handle 16 and the second electrical connector 38 of the cartridge barrel 20. The connector 38 includes a recess 139 which defines the socket for receiving the tab defined by the cover housing 85 of the connector 36. A combined length of: (a) the depth 144 of the recess 139, in a longitudinal direction with respect to the glue gun 10, which is also an engagement direction for slidably engaging the feeder handle 16 and the cartridge barrel 20 in the preferred embodiment, and (b) the length 146 of the cover housing 85 are longer than the length 148 of the protuberance 40. This provides an important safety feature since the protuberance 40 will not engage the switch plate 134 of the microswitch 132 until the cover housing 85 is disposed within the recess 139 to fully enclose the prongs 138 therein. Thus, a person operating the glue gun 10 will not be able to touch either of the contacts 136 or the prongs 138 when power is applied, since power is not applied by the protuberance 40 engaging the switch plate 134 until after the contacts 136 and the prongs 138 are fully enclosed within the combination of the length 146 of cover housing 85 and the depth 144 of the recess 139. When the connector 36 is engaged within the connector 38, the conductive prongs 138 will make electrical contact with the contacts 138, electrically connecting the cartridge barrel 20 to the feeder handle 16. When the cartridge barrel 20 is removed from the feeder handle 16, the connector 36 of the feeder handle 16 will be electrically disconnected from the both conductive legs of the power cord 20.

Referring again to FIG. 7, preferably, the resistance heater 140 comprises a ceramic heating element disposed between two conductive contact plates having slots for receiving the conductive prongs 138, with the plates and the heating element being wrapped with an electrical insulating paper. The heater 140 is included within the heating cartridge 22 for transferring heat thereto. The two prongs 138 which extend rearwardly from the heater 140 are lead wires which provide the conductive prongs 138 of the electrical connector 38. The prongs 138 are preferably spaced apart by about three-sixteenths inches. The prongs 138 extend rearwardly through the recess 139 of the electrical connector 38.

The heating cartridge 22 further includes is a thermally conductive metal body 142, which in the preferred embodiment is formed of cast aluminum. An interiorly disposed bore provides a feed passage 150 which extends through the thermally conductive metal body 142 for passage of the glue stick 15, and which defines a glue melt chamber having a longitudinal axis 152. A hole 154 extends into the thermally conductive metal body 142, preferably parallel to the interiorly disposed feed passage 150. The hole 154 is bored into the thermally conductive metal body 142 of the heating cartridge 22, formed as a blind hole. A smaller hole 156 is drilled into the other side of the conductive metal body 142, on the opposite end of the thermally conductive metal body 142 from the end into which the hole 154 is bored. The hole 156 intersects the hole 144, and both preferably extend parallel to the interiorly disposed passage 150. The heating element 140 is mounted within the hole 154, and directly contacts the interior surface of the hole 154 for transferring heat thereto in response to passage of electric current therethrough. Heat is transferred from the heating element 140, to the thermally conductive metal body 142, and then through the walls of the feed passage 150 to the glue stick 15 disposed therein. A circumferentially extending rib 143 is formed exteriorly into the surface of the metal body 142. A nozzle 145 is integrally formed in the forward end of the metal body 142 to provide a dispensing tip 147.

Figure 9:
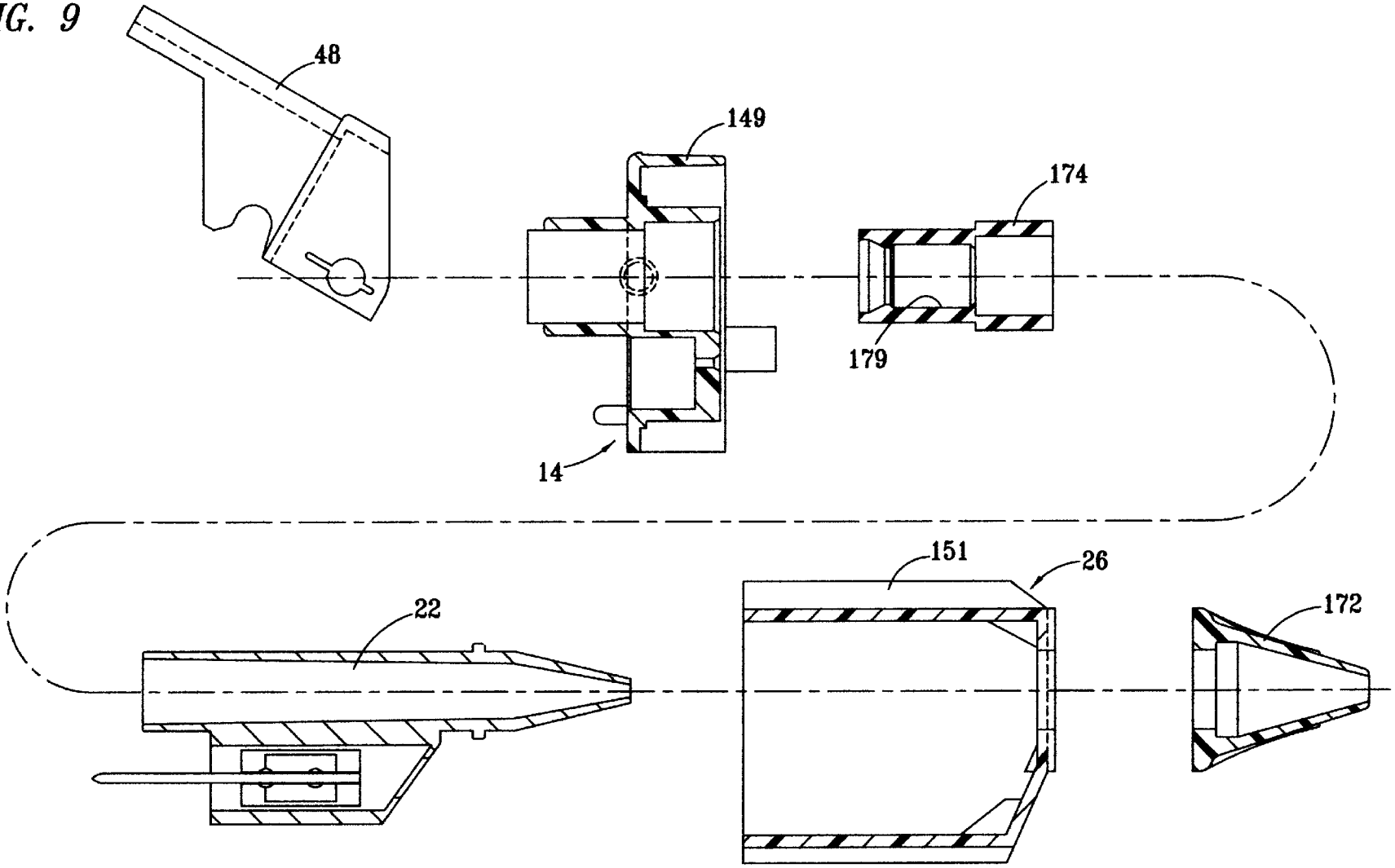
FIG. 9 illustrates an exploded view of a heater section of the glue gun, which includes the cartridge barrel, a heater element and a latch clasp.

Referring now to FIG. 9, there is illustrated an exploded view of the heater section 14. The dispenser section 14 comprises a latch clasp 48, a rearward portion 149 and forward portion 151 of the protective housing 26, a receiver-guide member 174, the heating cartridge 22, and the nozzle shroud 172. The rearward portion 149 is preferably sonically welded to the forward portion 151 to provide the protective housing 26, with the heating cartridge 22 and the receiver-guide member 174 contained therein to preferably permanently mount, that is, nonremovably mount, the heating cartridge 22 within the protective housing 26.

Figure 10:
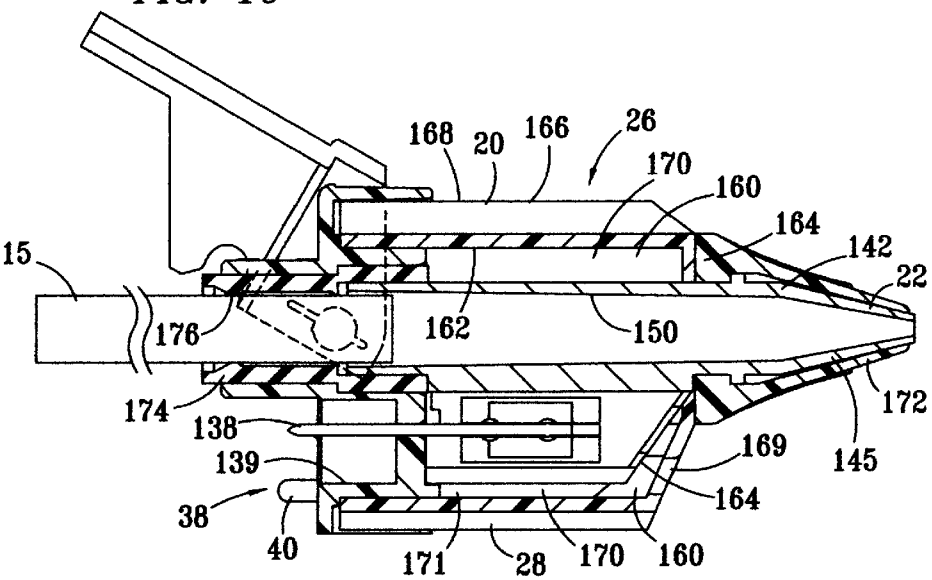
FIG. 10 illustrates a longitudinal, section view of the cartridge barrel of the glue gun, taken along a vertical plane.

Referring now to FIG. 10, there is illustrated a longitudinal, section view of the protective housing 26 of the cartridge barrel 20, taken along a vertical plane. The recess 139 is integrally formed into the rearward facing surface of the molded protective housing 26, providing a socket for receiving the cover housing 85 of the electrical connector 36 of the feeder handle 16. The protuberance 40 is also molded into the rearward facing end of the protective housing 26. The channel 28 is molded into lower end of the protective housing 36 for slidably engaging the upwardly protruding track portion 34 of the forward end 32 of the feeder handle 16.

The protective housing 26 of the cartridge barrel 20 is preferably molded of a plastic, named VALOX 865, available from General Electric Company, of Pittsfield, Mass. An interior cavity 160 is defined by an interior surface 162 of the protective housing 26. In the preferred embodiment, ribs 164 extend into the interior cavity 160 for supportively engaging the thermally conductive metal body 142 of the heating cartridge 22. The ribs 164 are preferably integrally molded into the protective housing 26. The molded protective housing 26 further includes exteriorly disposed fins 166, which are also integrally formed therewith. Exterior fins 166 provide an increased heat transfer surface area, and the terminal end tips 168 thereof are cool enough for a person operating the glue gun 10 to grasp the cartridge barrel 20 with bare hands when the heating member is at operating temperatures. The end tips 168 of the fins 166 define an exterior, laterally outermost surface of the protective housing 26. Air flow ports 169 are formed into the forward end of the protective housing 26 for passing heated air from the interior cavity 160 to the exterior of the protective housing 26. This reduces the interior temperatures of the protective housing 26 by convection, which results in a reduction in temperature of the exterior surface of the protective housing 26. Heated air flowing from within the interior cavity 160 and through the air flow ports 169 to the exterior of the protective housing 26 provides an energy conveyance means, which transports energy to the exterior of the glue gun 10 which would otherwise be conducted through the removable cartridge barrel 20, and to the exterior fins 166, which would raise the temperature of the end tips 168 thereof.

Still referring to FIG. 10, the metal body 142 of the heating cartridge 22 is mounted interiorly within the protective housing 26, supported therein by the terminal end tips of the ribs 164. A gap 170 extends between the exterior of the conductive metal body 142 of the heating cartridge 22 and the interior surface 162 of the protective housing 26. In some embodiments of the present invention, the gap 170 may be filled with a thermal insulating material 171. However, in the preferred embodiment, the insulating material 171 is not included and instead the gap 170 provides an insulating air gap in the space between the exterior of the heating cartridge 22 and the interior surface 162 of the protective housing 26 for thermally insulating the exterior of the protective housing 26 from the heating cartridge 22. The gap 170 is of a sufficient size such that the exterior surface of the protective housing 26 will not become hot enough to pose a thermal threat to a person utilizing the glue gun 10. Also, heated air will pass from the gap 170, through the air flow ports 169 of the protective housing 26, and outside of the housing 26. The removable cartridge barrel 20 further includes a forward end portion which provides a thermally protective shroud 172 that extends exteriorly around the forward dispensing end of the thermally conductive metal body 142 defined by the integral nozzle tip 145. The protective shroud 172 is preferably a separate piece from the protective housing 26, and is formed of Teflon.

The cartridge barrel 20 further includes a receiver-guide member 174 which is formed of Teflon. The receiver-guide member 174 is mounted to the heating cartridge 22, and has a central bore 176 which is coaxially aligned with the bore 150 of the conductive metal body 142 and seals against periphery of the glue stick 15 which extends rearward of the bore 150 to prevent melted glue from flowing rearward from the bore 150. The receiver-guide member 174 extends rearward from the bore 150 of the conductive body 142 for receiving the glue stick 15 from the feeder handle 16 and guiding it interiorly within bore 150 of the conductive body 142, which is disposed within the protective housing 26 of the cartridge barrel 20. Further, the receiver-guide member 174 is formed of Teflon such that it will thermally insulate the rearwardly protruding end of the thermally conductive metal body 142, preventing a person operating the glue gun 10 from being burned if they accidentally touch the rearward end of the cartridge barrel 20.

Figure 11:
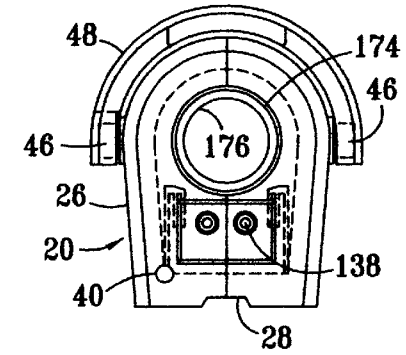
FIG. 11 illustrates a rear elevational view of the heater section, with heating element mounted within the cartridge barrel.

Referring now to FIG. 11, there is illustrated a side elevation view of the cartridge barrel 20 of the glue gun 10. The protuberance 40 extends from a left side of the rearward end of the cartridge barrel 20. The conductive prongs 138 extends from the heating element 140. The central passage defined by the bore 176 of the receiver-guide member 174, which is coaxially aligned with the bore 150, is disposed vertically above the heating element 140. The exterior profile of the lower end of the protective housing 26 defines the channel 28. The clasp 48 is mounted to the cartridge barrel 20. The clasp 48 is pivotally mounted to mounting posts 46 which extend from the exterior sides of the protective housing 26, and which are integrally molded to the protective housing 26. The clasp 48 is also preferably formed of a plastic, named VALOX 865, available from General Electric Company, of Pittsfield, Mass.

Figure 12:
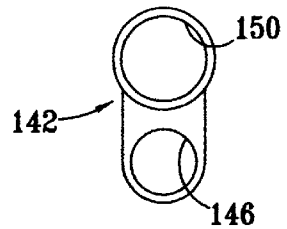
FIG. 12 illustrates an rear elevational view of a thermally conductive heater member of the heater section.

Referring now to FIG. 12, there is depicted a side elevational view of the rearward end of the cast aluminum heating member 142 of the heating cartridge 22. The holes 146 and 150 extend into the rearward end of the heating member 142.

Figure 13:
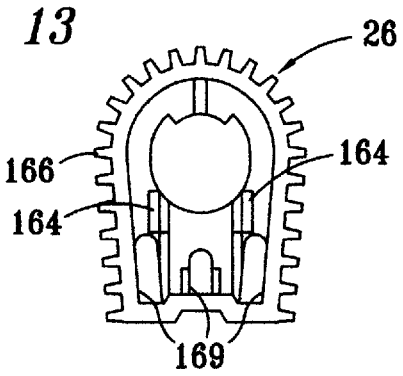
FIG. 13 illustrates an elevational view of the interior of the forward end of the protective housing of the removable cartridge barrel, viewed from the rear.

Referring now to FIG. 13, there is illustrated a side elevational view of the interior of the rearward side of the forward end of the protective housing 26 of the cartridge barrel 20. The ribs 164 and the air flow ports 169 are depicted. The fins 166 extend from the exterior of the protective housing 26.

Figure 14:
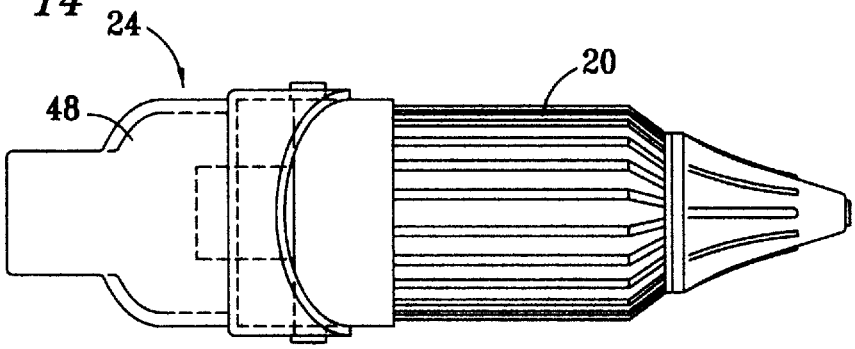
FIG. 14 illustrates a top view of the removable cartridge barrel.

Referring now to FIG. 14, there is illustrated a top view of the cartridge barrel 20, depicting the clasp 48 of the cartridge barrel latch 24, which is rotatably mounted to the cartridge barrel 20.

Figure 15:
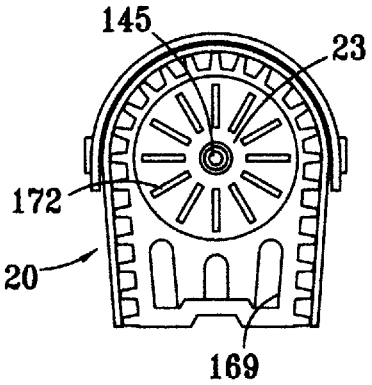
FIG. 15 illustrates a front view of the removable cartridge barrel.

Referring now to FIG. 15, there is illustrated a front view of the cartridge barrel 20, depicting the three air flow ports 169 in the forward end. The air flow ports 169 connect the gap 170 (shown in FIG. 10) to the exterior of the cartridge barrel 20 to transfer heat to the exterior of the cartridge barrel 20 by convection. Air ports 169 and the gap 170 together provide air flow paths for transferring heat from within the cavity 160 by convection. The protective shroud 172 is shown extending around the nozzle tip 145 of the nozzle 23 of the forward end of the heating member 142.

In operation, a glue stick 15 is inserted into the rearward end 33 of the feeder handle 16 and into the gripper aperture 94 of the carriage 90, and then pushed forward and into the heating cartridge 22 which is mounted within the cartridge barrel 20. Optionally, the glue stick 15 may be first mounted within the heating cartridge 22 of the cartridge barrel 20, prior to securing the cartridge barrel 20 to the feeder handle 16, and then the cartridge barrel 20 may be subsequently secured to the feeder handle 16. The cartridge barrel 20 is secured to the feeder handle 16 by first aligning the channel 28 of the barrel 20 with the protruding portion 34 of the forward end 32 of the feeder handle 16, and then sliding the cartridge barrel 20 toward the feeder handle 16 with the channel 28 and the protruding portion 34 in a sliding engagement. Then, a glue stick 15 protruding from the rear of the cartridge barrel 20 will automatically be inserted into the forward end 31 of the feeder handle 16. The clasp 48 may then engage the catches 46 to latch the cartridge barrel 20 to the feeder handle 16.

Pulling the feed trigger 104 rearward into the feeder handle 16 will cause the linkages 96 and 100 to pull the carriage 90 forward in a linear direction, causing the linkage 96 to pivot upwards and push the glue stick 15 upwards and into the upward surface of the gripper aperture 94 of the carriage 90, thereby gripping the glue stick 15 within the gripper aperture 94. With the glue stick 15 gripped within the gripper aperture 94, forward movement of the carriage 90 will push the glue stick 15 into the passage 150 of the heating cartridge 22 disposed in the cartridge barrel 20. Release of the feed trigger 104, which is preferably biased into a forward position by the spring 112, will cause the feed trigger 104 to return to a forward position, causing the carriage 90 to move rearward within the slots 59 and 89 of the tracks 58 and 88. Rearward movement of the carriage 90 causes the linkage 96 to move downward, releasing the glue stick 15 to move downward and release from the gripper aperture 94. This leaves the glue stick 15 stationary, in a forwardly disposed position, as the gripper aperture 94 and the carriage 90 move rearward.

The feed trigger 104 is repeatedly pressed to feed the glue stick 15 into the interiorly disposed passage 150 of the cartridge barrel 20. Heat will then transfer from the resistive heating element 140, through the thermally conductive metal body 142 of the heating cartridge 22, and into a portion of the glue stick 15 located within the interiorly disposed passage 150, which defines the glue melt chamber. Continued operation to cycle the feed trigger 104 into the rearward direction will continue to move the glue stick 15 forward within the chamber 150, pushing melted glue out of the dispenser tip defined by the nozzle 140 of the heating cartridge 22, which provides the forward end of the cartridge barrel 20 in the preferred embodiment.

When the person operating the hot glue dispenser 10 desires to dispense a glue of a different type, such as from a glue stick of a different shape, size, color or chemical composition than the glue stick 15, the cartridge barrel 20 may be removed from the feeder handle 16. The outermost ends of the clasp 48 of the latch 24 are rotated forward, freeing the catch posts 46 of the latch 24. The cartridge barrel 20 may then be removed from the dispenser section 12 by sliding barrel 20 forward of the feeder handle 16 with the channel 28 slidably engaging the protruding portion 34 of the feeder handle 16. Removal of the cartridge barrel 20 from the dispenser section 12 removes the protuberance 40 from pressing against the switch plate 134 of the electrical power switch 132 to automatically disconnect electrical power from the power connector 36, preferably disconnecting the hot leg of the power supply connected to the feeder handle 16. A second cartridge barrel may then be mounted to the feeder handle 16 by the reverse of the above procedure, slidably engaging the mounting channel 28 with the upwardly protruding portion 34 of the feeder handle 16 to automatically align a rearwardly extending protuberance of the second cartridge barrel for pressing against the switch plate 134 in the hole 86. Then the second cartridge barrel is latched to the feeder handle 16 by moving the clasp 48 over catch posts 46. Various ones of the cartridge barrels may be removed and mounted to the feeder handle 16 while the glue sticks rearwardly extend from within the interiorly disposed passages of the various cartridge barrels. Preferably, the nozzles of the cartridge barrel 20 may be interchanged between various ones of the heater sections.

Figure 16:
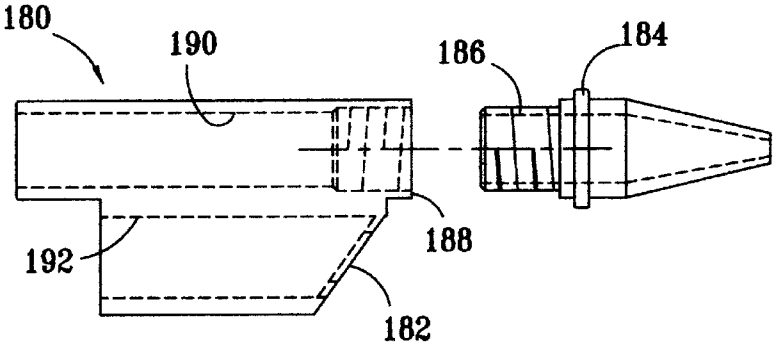
FIG. 16 illustrates a side view of a metal body portion of an alternative heating cartridge having a removable nozzle.

Referring now to FIG. 16, there is illustrated a side view of a metal body portion of an alternative heating cartridge 180, having a main metal body 182 and a removable nozzle 184. The end of the nozzle 184 has threads 186 for connecting to a threaded end 188 of a central passage 190 of the body 182. A lower bore 192 is provided for receipt of an electric heating element, such as the resistive heating element 140, discussed above. The ends of glue sticks are feed through the central passage 190 and heated therein by the electric heating element until melted, then dispensed through the nozzle 184.

Figure 17:
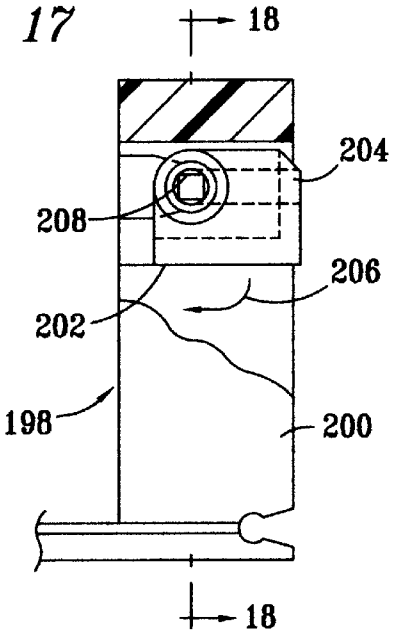
FIG. 17 illustrates a side elevational, partial cutaway view of a carriage of an alternative a feeder mechanism having a selectably adjustable gripper aperture.

Referring now to FIG. 17, there is illustrated a side elevational, partial cutaway view of a carriage 198 of a feeder mechanism of an alternative embodiment of the present invention. The carriage 198 has a slider body 200 with an adjustable gripper aperture 202, which is selectable by rotating a gripper member 204. The gripper member is rotatably supported within the slider body 200. Preferably, the gripper aperture 202 is adjustable between two positions, for accommodating one-half inch diameter glue sticks and for accommodating one-quarter inch glue sticks. The gripper member 204 is shown in the one-half inch glue stick feed position, and is moveable to the one-quarter inch glue stick feed position by being rotated ninety degrees in the angular direction 206 from the position shown. A square hole 208 is provided in one side of the gripper member 204 for receipt of a square post 210 (shown in FIG. 18), which is attached to an adjustment knob 212 (shown in FIG. 18).

Figure 18:
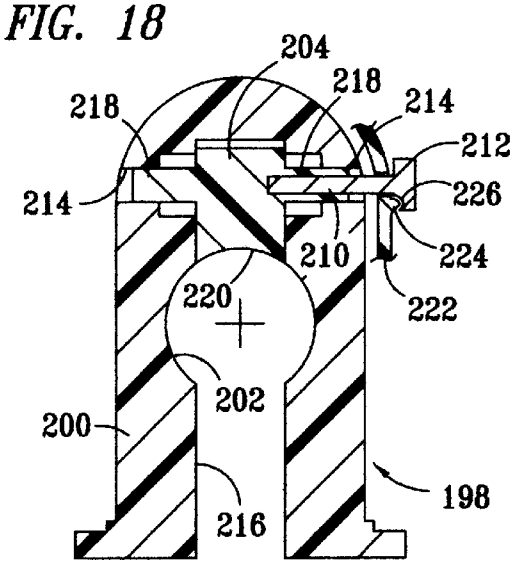
FIG. 18 illustrates a sectional view of the carriage having the selectably adjustable gripper aperture, shown in a one-half inch glue stick feed position.

Referring now to FIG. 18, there is illustrated a sectional view of the carriage 198, taken along section line 18—18 of FIG. 17, after the post 210 and the adjustment knob 212 have been mounted thereto. Longitudinally aligned holes 214 extend in an upper portion of the slider body 200, having concentric axes. A slot 216 extends vertically through the slider body 200, with central axis of the gripper aperture 202 intersecting the slot 216 at a right angle. Two bosses 218 extend from the gripper member 204 to provide pivot pins for engaging in the holes 214 to rotatably supporting the gripper member 204 within the slot 216. As shown, the lowermost surface 220 of the gripper member 204 is arcuate, being concave and defining a portion of the gripper aperture 202. The post 210 is shown extending within one of the bosses 218 and through an exterior housing 222 of a feeder handle. The post 210 is rigidly mounted to the gripper member 204. The adjustment knob 212 is rigidly mounted to the post 210. A protuberance 224 extends from the exterior of the housing 222 for engaging within a notch or indentation 226 formed into an inward side of the adjustment knob 212, to provide a detent or indexing means for selecting one of the two positions for the gripper member 204.

Figure 19:
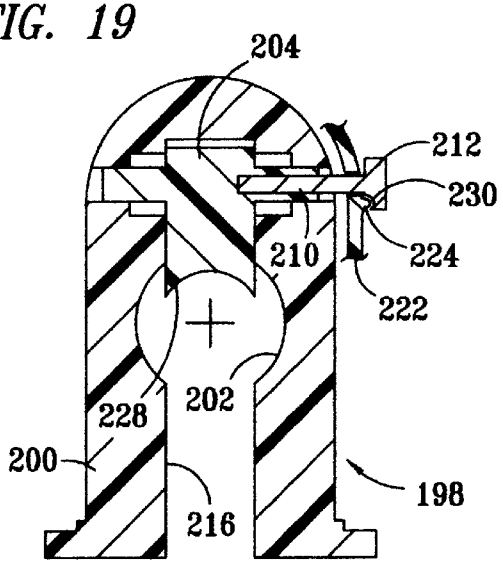
FIG. 19 illustrates a sectional view of the carriage having the selectably adjustable gripper aperture, shown in a one-quarter inch glue stick feed position.

Referring now to FIG. 19, there is illustrated a sectional view of the carriage 198, taken along section line 18—18 of FIG. 17, after the post 210 and the adjustment knob 212 have been mounted thereto and the gripper member 204 has been rotated within the slot 216 in the angular direction 206 from the one-half inch glue stick feed position to the one-quarter inch glue stick feed position. As shown, the gripper member 204 now has a lowermost gripper surface 228 which is further downward within the slot 216 than the gripper surface 220 was prior to rotating the gripper member 204. The surface 228 is arcuate, being concave, and defines a portion of the gripper aperture 202, which is smaller than that shown in FIG. 18. The protuberance 224 now extends into a second indentation 230 formed into an inward side of the adjustment knob 212, which also provides part of the detent or indexing means for selecting a second one of the two positions for gripper member 204.

The hot glue dispenser of the present invention provides several advantages over prior art hot glue dispensers. The hot glue dispenser of the present invention comprises a feeder handle and a removable cartridge barrel, which is releasibly mounted to the feeder handle by a readily releasable latch. The cartridge barrel encloses a heating cartridge having a glue melt chamber disposal therein. A person operating a hot glue dispenser made according to the present invention may simultaneously remove the cartridge barrel and the heater cartridge from the feeder handle by grasping the exterior of the cartridge barrel with bare hands, without fear of being burned when the heating cartridge disposed therein is at full operating temperature. This prevents injury which could be caused by inadvertently touching the surface of the heating cartridge. Additionally, when the cartridge barrel is removed from the feeder handle, power is automatically disconnected from the power connector exposed by removal of the cartridge barrel from the feeder handle. Heater sections can be freely interchanged for releasably mounting to the hot glue dispenser. Further, the feeder handle may be provided such that a feed assembly included therein has a selectably adjustable gripper aperture for accommodating glue sticks of various sizes with the same dispenser section. The heater cartridge may also have a removable nozzle.

Although the preferred embodiment has been described in detail, it should be understood that various changes, substitutions and alterations can be made therein without departing from the spirit and scope of the invention as defined by the appended claims.

What is claimed is:

1. An apparatus for dispensing a hot glue, comprising in combination:

a handle having a main body portion which defines a hand grip;

a cartridge barrel having a feed end, a dispensing end and an interior cavity extending interiorly therein, from said feed end to said dispensing end, said cartridge barrel being removably mounted to said handle;

a heating cartridge disposed within said interior cavity of said cartridge barrel, said heating cartridge having a feed passage for passing a stick of glue from said feed end to a discharge end of said heating cartridge and heating the stick of glue interiorly therein;

said heating cartridge further including a dispensing orifice disposed at said discharge end of said heating cartridge to define a dispensing tip for dispensing a melted end of the stick of glue;

a heating element for heating the stick of glue within said heating cartridge; and a feeder mechanism mounted to at least one of said handle and said cartridge barrel, said feeder mechanism including a feed member which is selectably moveable to advance the stick of glue toward said dispensing end of said cartridge barrel.

2. The apparatus according to claim 1, wherein said feed member defines a gripper aperture of said feeder mechanism which is adjustable to accommodate gripping of various sizes of sticks of glue.

3. The apparatus according to claim 2, wherein said feed member of said feeder mechanism comprises:

a gripper frame having said gripper aperture which extends parallel to a longitudinal axis of the stick of glue;

a gripper member which is moveably mounted to said gripper frame for moving into different glue size feed positions, in which said gripper member extends for different distances into said gripper aperture to in part define said gripper aperture; and an adjustment assembly having a shaft and an adjustment knob for moving relative to said gripper frame to move said gripper member between said different glue size feed positions.

4. The apparatus according to claim 1, wherein:

said heating cartridge includes a metal body and a removable nozzle;

said removable nozzle is releasably mounted to said metal body of heating cartridge and defines said dispensing tip; and said apparatus further comprises a thermally protective shroud which extends circumferentially around lateral sides of said removable nozzle.

5. The apparatus according to claim 1, further comprising:

said cartridge barrel including a plurality of lateral fins which extend longitudinally along an exterior surface of said cartridge barrel, transverse to said exterior surface;

said cartridge barrel is spaced apart from said heating cartridge with an air gap extending therebetween; and a plurality of retaining ribs which extend from an interior surface of said cartridge barrel and across said gap for retaining said thermally conductive metal body within said interior cavity of said cartridge barrel with said gap extending therebetween.

6. The apparatus according to claim 1, wherein said heating cartridge is permanently mounted within said cartridge barrel.

7. The apparatus according to claim 1, wherein said cartridge barrel is spaced apart from said heating cartridge with an air gap extending therebetween.

8. The apparatus according to claim 7, wherein said cartridge barrel includes at least one air flow port for passing air from within said air gap to an exterior of said cartridge barrel.

9. The apparatus according to claim 1, wherein:

one of said cartridge barrel and said handle includes a mounting channel, and the other of said cartridge barrel and said handle includes a protruding portion; and said protruding portion engages within said mounting channel to align said cartridge barrel with said main body portion of said handle when said cartridge barrel is mounted to said handle.

10. The apparatus according to claim 1, further comprising:

a first electrical power connector mounted to said handle and connected to a power source; and a second electrical power connector mounted to said cartridge barrel for engaging said first electrical connector to electrically connect said heating element to the power source.

11. The apparatus according to claim 10, further comprising:

an electric switch mounted to said handle and connecting said first electrical power connector to the power source; and an actuation member mounted to said cartridge barrel for actuating said electric switch to automatically connect said first power connector to the power source when said cartridge barrel is mounted to said handle.

12. An apparatus for dispensing hot glue, comprising in combination:

a handle having a main body portion which extends to define a hand grip;

a first power connector mounted to said handle and connected to a power source;

an electrical power switch mounted to said handle for actuating to disconnect said first power connector from said power source;

a protective housing having a feed end, a dispensing end and an interior cavity extending interiorly therein, from said feed end to said dispensing end, said protective housing being removably mounted to said handle;

said protective housing further having an actuator member for actuating said electrical power switch to automatically disconnect said power source from said first power connector when said protective housing is removed from said handle;

a heating cartridge disposed within said interior cavity of said protective housing, said heating cartridge having a feed passage for passing the a stick of the glue to a discharge end of said heating cartridge and an electric heating element for heating the stick of glue within said feed passage;

said heating cartridge further including a dispensing orifice disposed at said discharge end of said heating cartridge to define a dispensing tip for dispensing a melted end of the stick of glue;

a second power connector connected to said electrical heating element and mounted to said protective housing for engaging with said first power connector to electrically connect said electric heating element to the power source when said protective housing is mounted to said handle; and a feeder mechanism mounted to at least one of said handle and said protective housing, said feeder mechanism including a feed member which is selectably moveable to advance the stick of the glue toward said discharge end of said heating cartridge.

13. The apparatus according to claim 12, wherein said actuator member of said protective housing is a protuberance which rearwardly extends from said protective housing for pressing against a second actuator member to actuate said electrical power switch when said protective housing is mounted to said handle.

14. The apparatus according to claim 12, wherein:

said first power connector includes a tab which extends from said forward end of said main body portion of said handle, with a pair of electrical contacts disposed within said tab to face forward of said tab;

said second power connector includes a recess defined on said feed end of said protective housing, and a pair of electrically conductive prongs which are disposed within said recess; and said tab extends within said recess to electrically connect said pair of electrically conductive prongs to respective ones of said pair electrical contacts when said protective housing is mounted to said feeder handle.

15. The apparatus according to claim 14, wherein the combination of the depth of said recess and the length of said tab along an engagement direction is larger than a length of a protuberance which extends from said protective housing and which defines said actuator member.

16. The apparatus according to claim 12, wherein said feed member of said feeder mechanism defines a gripper aperture of said feeder mechanism which is adjustable to accommodate gripping of various sizes of sticks of glue.

17. The apparatus according to claim 16, wherein said feed member of said feeder mechanism comprises:

a gripper frame having said gripper aperture which extends parallel to a longitudinal axis of the stick of glue;

a gripper member which is moveably mounted to said gripper frame for moving into different glue size feed positions, in which said gripper member extends for different distances into said gripper aperture to in part define said gripper aperture; and an adjustment assembly having a shaft and an adjustment knob for moving relative to said gripper frame to move said gripper member between said different glue size feed positions.

18. The apparatus according to claim 12, wherein:

said dispensing tip of said heating cartridge is defined by a nozzle which is releasably mounted to said heating cartridge; and said apparatus further comprises a thermally protective shroud which extends circumferentially around lateral sides of said nozzle, from said dispensing tip to a first end of said nozzle.

19. The apparatus according to claim 12, further comprising:

said protective housing including a plurality of lateral fins which extend laterally from and longitudinally along an exterior surface of said protective housing; and a plurality of ribs which laterally extend from an interior surface of said protective housing and across said gap for retaining said thermally conductive metal body within said interior cavity of said protective housing with said gap extending therebetween.

20. The apparatus according to claim 12, wherein said protective housing is spaced apart from said heating cartridge with an air gap extending therebetween, and further includes at least one air flow port for passing air from within said air gap to an exterior of said protective housing.

21. An apparatus for dispensing hot glue, comprising in combination:

a feeder handle having a forward end, a rearward end and a main body portion which extends from between said forward and rearward ends to define a pistol grip, said forward and rearward ends defining apertures for feeding a stick of the glue through said main body portion of said feeder handle;

a feeder mechanism mounted to said feeder handle, said feeder mechanism having a feed trigger which is pivotally connected to a plurality of linkages, a first one of said linkages being pivotally connected to said feed trigger and a second one of said linkages being pivotally connected to a slidable carriage, said feeder mechanism further having at least one slider rail for slidably receiving said slidable carriage for relative motion therebetween, and a gripper mounted to said slidable carriage for selectively gripping the stick of the glue as said slidable carriage moves in a forward direction;

an electrical power switch and a first power connector mounted to said forward end of said feeder handle in a spaced apart arrangement, said first power connector having electrical contacts;

a protective housing having a feed end, a dispensing end and an interior cavity extending interiorly therein, from said feed end to said dispensing end, said protective housing being removably mounted to said feeder handle and having a protuberance which extends therefrom for engaging said electrical power switch when said protective housing is mounted to said feeder handle and which is removed from engaging said electrical power switch for automatically disconnecting electrical power from said first power connector when said protective housing is removed from said feeder handle;

a second power connector mounted to said protective housing, spaced apart from said protuberance according to said spaced apart arrangement of said electrical power switch and said first power connector, such that said second power connector will mate with and electrically connect to said first power connecter when said protective housing is removably installed onto said feeder handle and said protuberance engages said electrical power switch, and wherein said second power connector includes electrically conductive prongs for extending against said electrical contacts of said first electrical connector;

a thermally conductive metal body disposed within said interior cavity of said protective housing with a gap extending between said thermally conductive metal body and said protective housing, substantially fully around said thermally conductive metal body;

said thermally conductive metal body having an interiorly disposed passage extending linearly therethrough for receiving the stick of the glue from said feeder handle and passing the glue therethrough and toward a dispensing tip which is disposed proximate to the dispensing end of said protective housing;

said thermally conductive metal body further having a hole which is spaced apart from and extends substantially parallel to said interiorly disposed passage; and an electric heating element disposed within said hole of said thermally conductive member, wherein said electric heating element is electrically connected to said electrically conductive prongs of said protective housing.

22. The apparatus according to claim 21, wherein:

said dispensing tip is defined by a nozzle which comprises a first end for removably securing to a dispensing end of said thermally conductive metal body, aligned with said interiorly disposed passage for receiving melted ends of the sticks of the glues, and said nozzle having a second end which defines said dispensing tip;

said dispensing tip is disposed exterior of said protective housing for dispensing the melted ends of the stick of glue from within said interiorly disposed passage of said thermally conductive metal body; and said protective housing further comprises a thermally protective shroud which extends circumferentially around lateral sides of said nozzle, from said dispensing tip to said first end.

23. The apparatus according to claim 21, wherein said slidable carriage defines a gripper aperture of said feeder mechanism which is adjustable to accommodate gripping of various sizes of sticks of glue, and said feeder mechanism comprises:

said slidable carriage having said gripper aperture which extends parallel to a longitudinal axis of the stick of glue;

said gripper member which is moveably mounted to said slidable carriage for moving into different glue size feed positions, in which said gripper member extends for different distances into said gripper aperture to in part define said gripper aperture; and an adjustment assembly having a shaft and an adjustment knob for moving relative to said slidable carriage to move said gripper member between said different glue size feed positions.

24. The apparatus according to claim 21, wherein:

said first power connector includes a tab which extends from said forward end of said main body portion of said feeder handle, with said electrical contacts disposed within said tab to face forward of said tab;

said electrically conductive prongs of said second power connector are disposed within a recess defined within said feed end of said protective housing; and said tab extends within said recess to electrically connect said electrically conductive prongs to said electrical contacts when said protective housing is mounted to said feeder handle.

25. The apparatus according to claim 21, wherein said protective housing includes at least one air flow port for passing air from within said gap to an exterior of said protective housing.

26. A method for dispensing hot glue, comprising the steps of:

providing a hot glue dispenser having a feeder handle, a feeder mechanism, and a first and second protective housings which are removably mountable to said feeder handle, the first and second protective housings each having an interior cavity within which a first and second heating cartridges, respectively, are disposed;

mounting the first protective housing to the feeder handle, with the feeder mechanism aligned for feeding a first stick of the glue into the first heating cartridge;

operating the feeder mechanism to feed the first stick of glue into the first heating cartridge;

melting a forward end of the first stick of glue within the first heating cartridge;

continuing to feed the first stick of glue into the first heating cartridge, which pushes the melted forward end of the first stick forward and from within the first heating cartridge, to dispense the melted forward end of the first stick from the hot glue dispenser;

gripping the first protective housing around a main body portion and removing the first protective housing from the feeder handle with the first heating cartridge secured within the first protective housing and a remaining portion of the first stick of the glue disposed within the heating cartridge;

automatically disconnecting electrical power from a first electrical connector mounted to the feeder handle by removing the first protective housing from the feeder handle; and mounting the second protective housing to the feeder handle, which automatically connects electrical power to a second electrical connector mounted to the feeder handle.

27. The method according to claim 26, further comprising the step of:

prior to removing the first protective housing from the feeder handle, replacing the first stick of glue with a smaller stick of glue, which has a diameter which is not substantially larger than 75% of the size of the outside diameter of the first stick of glue; and selectively adjusting the feeder mechanism to accommodate feeding of the smaller stick of glue.

28. The method according to claim 26, further comprising the step of:

disconnecting electrical power from the hot glue dispenser; and then continuing to dispense the hot glue, with heat stored within the thermal mass of the heating cartridge providing a heat source for continued dispensing of the glue.

* * * * *